US012460871B2

(12) United States Patent
Hara et al.

(10) Patent No.: US 12,460,871 B2
(45) Date of Patent: Nov. 4, 2025

(54) HEAT EXCHANGER

(71) Applicant: MITSUBISHI HEAVY INDUSTRIES, LTD., Tokyo (JP)

(72) Inventors: Nobuhide Hara, Tokyo (JP); Koichi Tanimoto, Tokyo (JP); Tadahiko Suzuta, Tokyo (JP); Hiroyuki Nakaharai, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 228 days.

(21) Appl. No.: 18/162,966

(22) Filed: Feb. 1, 2023

(65) Prior Publication Data

US 2023/0251041 A1 Aug. 10, 2023

(30) Foreign Application Priority Data

Feb. 4, 2022 (JP) ..... 2022-016358

(51) Int. Cl.
*F28D 7/16* (2006.01)
*F28F 9/02* (2006.01)
*F28F 9/22* (2006.01)

(52) U.S. Cl.
CPC ..... *F28D 7/1607* (2013.01); *F28F 9/02* (2013.01); *F28F 9/22* (2013.01)

(58) Field of Classification Search
CPC ..... F28D 7/1607; F28D 7/1684; F28D 7/16; F28F 9/02; F28F 9/22; F28F 1/04; F28F 1/12; F28F 13/08; F28F 21/083; F28F 21/086; B33Y 80/00
USPC ..... 165/157, 158, 159, 164
See application file for complete search history.

(56) References Cited

U.S. PATENT DOCUMENTS 697,560 A * 4/1902 Steinmetz ..... F22B 37/04 219/67
1,743,785 A * 1/1930 Leszczyk ..... F28F 9/0221 165/DIG. 468
1,840,510 A * 1/1932 Kelley ..... F28D 7/0041 228/183
1,995,768 A * 3/1935 Fesenmaier ..... F28F 9/0221 165/157

(Continued)

FOREIGN PATENT DOCUMENTS

CN 115135946 B * 7/2025 ..... F28D 7/10
EP 3842723 A1 * 6/2021 ..... B33Y 80/00

(Continued)

*Primary Examiner* — Ljiljana V. Ciric
(74) *Attorney, Agent, or Firm* — Osha Bergman Watanabe & Burton LLP

(57) ABSTRACT

A heat exchanger includes a pipe main body forming a flow path to which a first fluid is supplied, a pair of partition plates defining an enclosed space, a plurality of heat transfer tubes, a supply portion configured to supply a second fluid into the enclosed space, a discharge portion configured to discharge the second fluid in the enclosed space, and a flow path forming portion forming a plurality of small flow path portions between the heat transfer tubes adjacent to each other. The second fluid flows between the plurality of heat transfer tubes in the enclosed space in a direction opposite to the flow direction of the first fluid. The plurality of small flow path portions are disposed at positions different from each other in an extension direction when viewed from a position where the discharge portion is disposed.

7 Claims, 8 Drawing Sheets

(56) References Cited

U.S. PATENT DOCUMENTS 2,322,047 A * 6/1943 Mormile ..... F01M 5/007 165/103
2,388,721 A * 11/1945 Clancy ..... F28F 9/0221 165/DIG. 422
2,396,650 A * 3/1946 Hannah ..... F16N 39/02 165/178
2,424,795 A * 7/1947 Burns ..... F28F 9/22 165/170
2,433,546 A * 12/1947 Cornelius ..... B29C 66/5227 228/183
2,449,922 A * 9/1948 Andersen ..... F16N 39/02 165/162
2,474,689 A * 6/1949 Ramsaur ..... F01P 11/08 165/286
2,505,695 A * 4/1950 Villiger ..... F28F 9/0135 126/109
2,568,984 A * 9/1951 Bowsher ..... F28F 9/0132 165/160
2,577,123 A * 12/1951 Hitchens ..... B23K 31/02 376/261
2,577,124 A * 12/1951 Newcomer ..... B23K 31/02 228/235.1
2,793,835 A * 5/1957 Woods ..... F28D 7/0041 165/172
2,803,440 A * 8/1957 Simpelaar ..... F28F 1/42 165/158
3,297,081 A * 1/1967 Nunemaker ..... F28F 9/0221 165/DIG. 422
3,610,330 A * 10/1971 Nasser ..... F28D 7/16 165/158
3,630,276 A * 12/1971 Paine ..... F22B 3/02 165/161
3,681,936 A * 8/1972 Park ..... F24F 5/00 62/99
3,720,071 A * 3/1973 Nasser ..... B01D 5/0012 62/903
3,782,457 A * 1/1974 Troy ..... F02C 7/08 165/158
3,802,499 A * 4/1974 Garcea ..... F28D 7/10 165/DIG. 407
3,812,907 A * 5/1974 Linning ..... F28F 9/0219 165/83
3,907,026 A * 9/1975 Mangus ..... F22B 1/063 165/142
3,958,630 A * 5/1976 Smith ..... F28F 9/22 165/161
3,961,665 A * 6/1976 Langbroek ..... F28D 7/12 95/290
3,967,677 A * 7/1976 Mohlman ..... F28F 9/22 165/162
4,093,022 A * 6/1978 Polyak, Jr. ..... F28D 21/0008 165/157
4,128,126 A * 12/1978 Forster ..... F28F 9/0075 165/165
4,192,374 A * 3/1980 Hayden ..... F28F 9/013 228/183
4,193,443 A * 3/1980 Nanaumi ..... F28D 7/0066 165/113
4,203,906 A * 5/1980 Takada ..... F28D 7/0066 552/296
4,212,351 A * 7/1980 Van Hagan ..... F28F 9/0135 376/389
4,221,261 A * 9/1980 Wunder ..... F28F 9/0202 165/905
4,265,301 A * 5/1981 Anderson ..... F28F 9/013 248/68.1
4,271,900 A * 6/1981 Reitz ..... F28F 21/062 165/DIG. 417
4,286,366 A * 9/1981 Vinyard ..... F28F 9/0132 165/162
4,308,990 A * 1/1982 Borovina ..... F24D 5/04 236/38
4,357,991 A * 11/1982 Cameron ..... F28F 9/22 165/910
4,426,037 A * 1/1984 Bernstein ..... F28D 7/0083 122/18.4
4,429,739 A * 2/1984 Gentry ..... F22B 37/205 165/162
4,436,146 A * 3/1984 Smolarek ..... F28F 9/00 165/DIG. 207
4,441,549 A * 4/1984 Vasiliev ..... F28F 9/22 165/145
4,450,904 A * 5/1984 Volz ..... B23P 15/26 165/DIG. 422
4,451,960 A * 6/1984 Molitor ..... B21D 53/027 228/183
4,573,911 A * 3/1986 Kimmich ..... E21B 36/00 165/161
4,633,940 A * 1/1987 Gentry ..... F28D 7/06 165/DIG. 417
4,660,631 A * 4/1987 Small ..... F28F 9/22 165/162
4,732,585 A * 3/1988 Lerner ..... F28F 13/06 261/153
4,750,553 A * 6/1988 Pohl ..... F28F 9/0221 165/174
4,808,262 A * 2/1989 Aneja ..... C08F 6/003 203/88
RE33,444 E * 11/1990 Lerner ..... B01D 45/10 261/153
4,991,648 A * 2/1991 Magari ..... F28F 9/22 165/161
5,069,169 A * 12/1991 Maruko ..... F28D 7/12 165/142
5,192,499 A * 3/1993 Sakai ..... A61M 1/1698 165/905
5,253,701 A * 10/1993 Leidinger ..... F28F 19/006 165/110
5,258,165 A * 11/1993 Olsen ..... C01B 13/11 422/186.18
5,323,849 A * 6/1994 Korczynski, Jr. ..... F28F 11/00 165/905
5,349,829 A * 9/1994 Tsimerman ..... F24F 5/0035 261/153
5,411,080 A * 5/1995 Gentry ..... F28F 9/013 165/162
5,447,195 A * 9/1995 Luyts ..... F28F 9/22 165/162
5,517,828 A * 5/1996 Calton ..... F24F 12/003 62/271
5,551,245 A * 9/1996 Calton ..... F24F 3/1423 62/271
5,553,665 A * 9/1996 Gentry ..... F28F 9/0132 165/69
5,915,472 A * 6/1999 Takikawa ..... F02M 26/32 165/158
5,971,064 A * 10/1999 Palm ..... F28F 19/002 165/158
6,058,010 A * 5/2000 Schmidt ..... H05K 7/1422 361/689
6,155,337 A * 12/2000 Rosengarten ..... F28F 19/02 29/890.038
6,250,379 B1 * 6/2001 Geissler ..... F28F 9/013 165/145
6,378,605 B1 * 4/2002 Kutscher ..... F28F 13/003 165/181
6,498,827 B1 * 12/2002 Klarner ..... F28F 21/082 376/442
6,536,513 B1 * 3/2003 Font-Freide ..... C01B 3/384 165/140
6,568,467 B1 * 5/2003 Ohira ..... F28D 7/024 165/163
6,604,573 B2 * 8/2003 Morishima ..... F28D 20/003 165/84
6,609,562 B2 * 8/2003 Font-Freide ..... F28F 9/0236 165/159
6,880,623 B2 * 4/2005 Gierlings ..... F28D 7/103 165/145

(56) References Cited

U.S. PATENT DOCUMENTS 6,889,751 B1 * 5/2005 Lukas ..... F28D 20/02 165/902
7,220,048 B2 * 5/2007 Kohlgruber ..... B01F 25/4316 165/172
7,240,723 B2 * 7/2007 Wu ..... F28F 9/0221 165/158
7,776,287 B2 * 8/2010 Hugues ..... B01J 8/22 165/145
7,793,708 B2 * 9/2010 Wanni ..... F28F 9/0132 165/69
8,034,308 B2 * 10/2011 Chiu ..... F28F 9/0265 165/172
8,079,410 B2 * 12/2011 Kim ..... F02M 26/32 165/161
8,168,131 B2 * 5/2012 Burlingame ..... B01J 8/065 422/647
8,177,888 B2 * 5/2012 McClanahan ..... F23K 5/002 96/417
8,246,915 B2 * 8/2012 Boer ..... B01J 35/40 165/172
8,360,139 B2 * 1/2013 Inatomi ..... F28F 7/02 165/157
8,387,684 B2 * 3/2013 Capelle ..... F28D 1/0475 165/69
8,404,188 B2 * 3/2013 Barbieri ..... B01J 8/025 422/198
8,522,537 B2 * 9/2013 Lee ..... F01N 3/0205 60/320
8,757,248 B2 * 6/2014 Postma ..... F28D 7/1653 165/173
8,776,872 B2 * 7/2014 Capelle ..... F01N 3/0205 165/158
8,869,877 B2 * 10/2014 Zaffetti ..... F28F 9/026 165/80.4
9,068,782 B2 * 6/2015 Kar ..... F28D 7/16
9,188,380 B2 * 11/2015 Lu ..... G05D 23/00
9,541,331 B2 * 1/2017 Nagurny ..... F28F 21/084
10,627,166 B2 * 4/2020 Nakamura ..... F28D 7/12
10,697,714 B2 * 6/2020 Koyama ..... F23J 1/00
10,823,510 B2 * 11/2020 Chordia ..... B01J 19/249
11,118,838 B2 * 9/2021 Joseph ..... F28D 1/0475
11,120,920 B2 * 9/2021 Singh ..... G21D 1/006
11,143,107 B2 * 10/2021 Nakamura ..... F28G 1/163
11,168,942 B2 * 11/2021 Becene ..... F28D 1/047
11,209,222 B1 * 12/2021 Colson ..... F28F 9/24
11,243,030 B2 * 2/2022 Herring ..... F28F 7/02
11,268,770 B2 * 3/2022 Ruiz ..... F28F 9/0263
11,274,886 B2 * 3/2022 Becene ..... F28D 7/024
11,353,266 B2 * 6/2022 Sabau ..... F28D 7/1607
11,415,377 B2 * 8/2022 Sawicki ..... F28D 7/0025
11,530,881 B2 * 12/2022 Trojosky ..... F28F 13/12
11,754,349 B2 * 9/2023 Maynard ..... F28D 7/1669 165/158
11,992,789 B2 * 5/2024 Porro ..... B01D 3/346
12,130,090 B2 * 10/2024 Ruiz ..... F28F 9/0263
2003/0006026 A1 * 1/2003 Matsumoto ..... B01J 8/067 165/157
2003/0010479 A1 * 1/2003 Hayashi ..... F02M 26/32 165/157
2004/0206485 A1 * 10/2004 Ferraro ..... F28D 7/0016 165/156
2004/0256088 A1 * 12/2004 Ayub ..... F25B 39/02 165/158
2006/0151147 A1 * 7/2006 Symonds ..... F28F 27/02 165/284
2010/0170210 A1 * 7/2010 McClanahan ..... B01D 45/06 165/185
2010/0200203 A1 8/2010 Postma et al.
2011/0132583 A1 * 6/2011 Vironneau ..... F24F 12/006 165/164
2011/0132586 A1 * 6/2011 Diehl ..... F02M 26/32 165/157
2012/0199324 A1 * 8/2012 Pazzaglia ..... B01J 8/1836 165/104.34
2012/0199331 A1 8/2012 Maurer et al.
2013/0031900 A1 * 2/2013 Nelson ..... F28D 7/1607 165/157
2013/0327506 A1 * 12/2013 Pazzaglia ..... F28F 9/00 165/157
2015/0323260 A1 * 11/2015 Greber ..... F28D 9/0068 29/890.03
2016/0003552 A1 * 1/2016 Chordia ..... F28F 9/02 165/173
2021/0131752 A1 * 5/2021 Wu ..... F28D 7/1646
2023/0089621 A1 * 3/2023 Hara ..... F28F 9/013 165/164
2023/0251041 A1 * 8/2023 Hara ..... F28D 7/1684 165/174

FOREIGN PATENT DOCUMENTS

JP 2006192430 A 7/2006
JP 2010-223520 A 10/2010
JP 2010532858 A 10/2010
JP 2011196620 A 10/2011
WO WO-2005075065 A1 * 8/2005 ..... B01J 35/40

* cited by examiner

HEAT EXCHANGER

BACKGROUND OF THE INVENTION

Field of the Invention

The present disclosure relates to a heat exchanger.

Priority is claimed on Japanese Patent Application No. 2022-016358, filed on Feb. 4, 2022, the content of which is incorporated herein by reference.

Description of Related Art

Some heat exchangers have a configuration including a pipe and a plurality of heat transfer tubes disposed in the pipe. The heat exchanger having such a configuration exchanges heat between a first fluid flowing inside the plurality of heat transfer tubes and a second fluid flowing outside the heat transfer tubes inside the pipe. For example, Patent Document 1 discloses a configuration in which heat transfer tubes are provided with fins. By providing the fins to the heat transfer tubes, a heat exchange efficiency between the first fluid flowing inside the heat transfer tubes and the second fluid flowing outside the heat transfer tubes is increased.

CITATION LIST

Patent Document

[Patent Document 1] Japanese Unexamined Patent Application, First Publication No. 2010-223520

SUMMARY OF THE INVENTION

By the way, it is sometimes desired to reduce a size of the heat exchanger. In such a case, narrowing gaps between the plurality of heat transfer tubes disposed in the pipe reduces a flow path cross-sectional area of the second fluid flowing outside the heat transfer tubes. As a result, the heat exchange efficiency between the first fluid inside the heat transfer tubes and the second fluid outside the heat transfer tubes may decrease. Therefore, it is desired to increase the heat exchange efficiency between the first fluid inside the heat transfer tubes and the second fluid outside the heat transfer tubes even in a configuration in which the gaps between the plurality of heat transfer tubes are narrowed.

The present disclosure provides a heat exchanger capable of increasing a heat exchange efficiency between the first fluid inside the heat transfer tubes and the second fluid outside the heat transfer tubes.

A heat exchanger according to the present disclosure includes: a pipe main body forming a flow path to which a first fluid is supplied; a pair of partition plates that are spaced apart in an extension direction of the pipe main body, block part of the flow path in the extension direction, and define a closed space in part of the flow path; a plurality of heat transfer tubes that have a tubular shape with both ends open, extend in the extension direction to penetrate the pair of partition plates, and are disposed side by side at intervals; a supply portion configured to supply a second fluid from an outside of the pipe main body into the closed space; a discharge portion that is spaced apart from the supply portion in the extension direction and configured to discharge the second fluid in the closed space to the outside of the pipe main body; and a flow path forming portion that forms a plurality of small flow path portions between the heat transfer tubes that are adjacent to each other at closest positions in the plurality of heat transfer tubes, in which the second fluid flows between the plurality of heat transfer tubes in the closed space in a direction opposite to a flow direction of the first fluid, and the plurality of small flow path portions are disposed at positions different from each other when viewed from a position where the discharge portion is disposed in the extension direction.

According to the heat exchanger of the present disclosure, the heat exchange efficiency between the first fluid inside the heat transfer tubes and the second fluid outside the heat transfer tubes can be increased.

DETAILED DESCRIPTION OF THE INVENTION

Hereinafter, embodiments for implementing a heat exchanger according to the present disclosure will be described with reference to the accompanying drawings. However, the present disclosure is not limited to only these embodiments.

(Configuration of Heat Exchanger)

Figure 1:
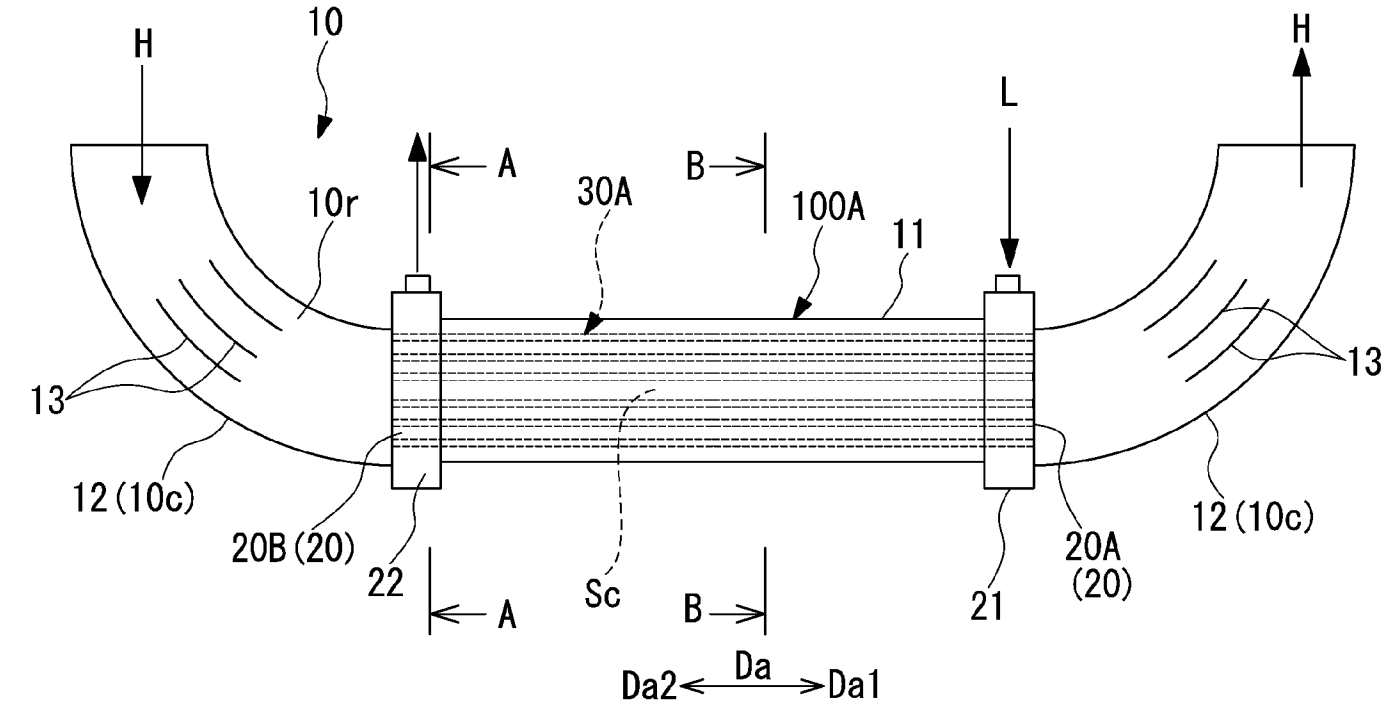
FIG. 1 is a view showing a schematic configuration of a heat exchanger according to an embodiment of the present disclosure.

As shown in FIG. 1, a heat exchanger 100A is disposed in the middle of a pipe 10. The pipe 10 forms a flow path 10*r* through which a first fluid H flows. In the present embodiment, as the first fluid H, for example, a hydrogen gas flows through the flow path 10*r* in the pipe 10. In the present embodiment, the pipe 10 includes a straight pipe main body 11 and elbow portions 12 disposed at both end portions of the pipe main body 11. The elbow portion 12 forms a bent portion 10*c* of the flow path 10*r*. The elbow portion 12 is connected to the pipe main body 11. Inside the elbow portion 12, a plurality of vanes 13 are disposed for guiding a flow direction of the first fluid H to match the bent portion 10*c*. Each vane 13 is curved along a curve of the elbow portion 12. A plurality of the vanes 13 are disposed in the elbow portion 12 at intervals in a width direction of the flow path 10*r*. A disposition of the pipe main body 11 is not limited to being connected to a curved portion of the pipe 10 such as the elbow portion 12. The pipe main body 11 may be disposed as part of the pipe 10.

Figure 2:
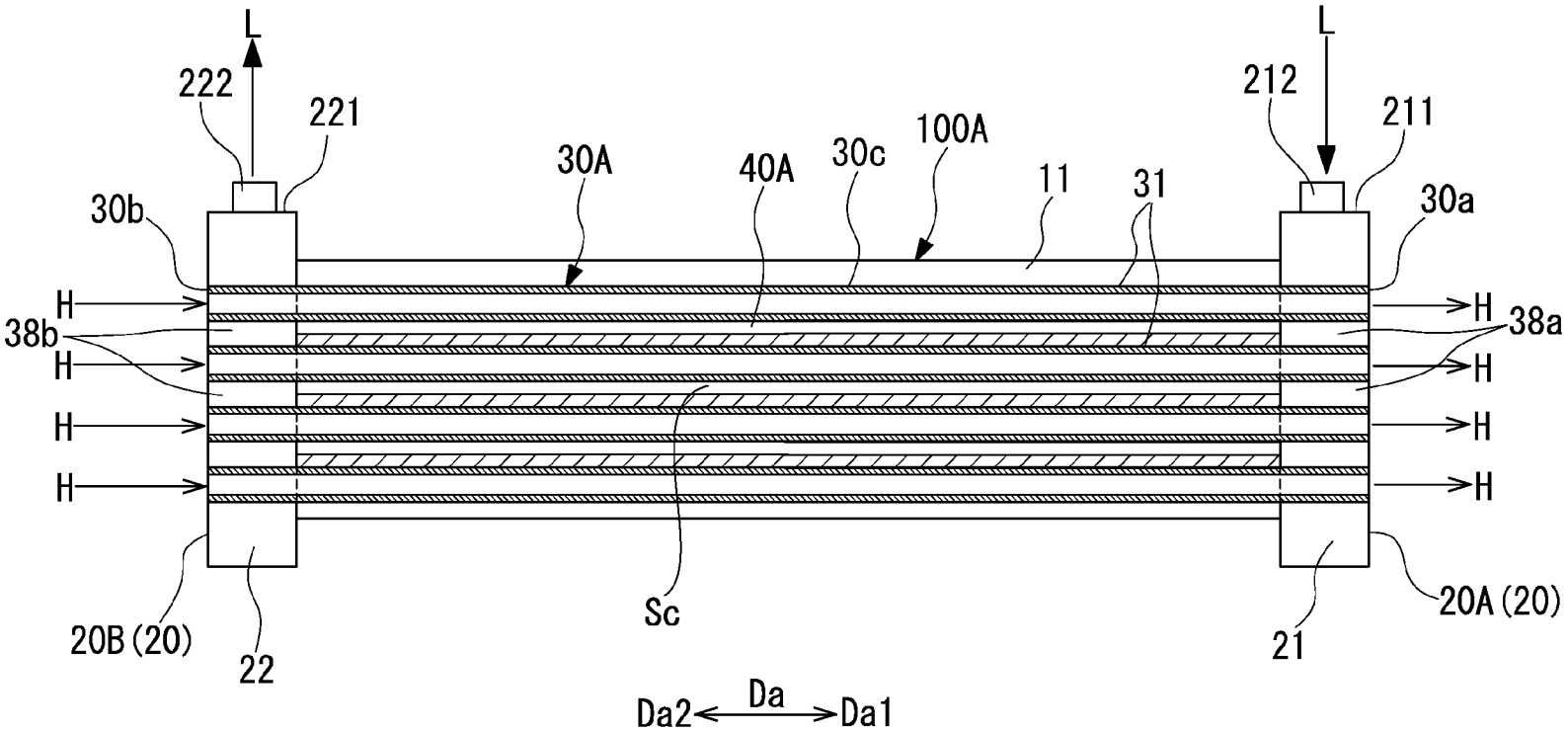
FIG. 2 is a cross-sectional view showing an internal structure of the heat exchanger according to the first embodiment of the present disclosure.

As shown in FIGS. 1 and 2, in the present embodiment, the heat exchanger 100A is installed at a position where the pipe main body 11 is disposed so as to form part of the pipe 10. The heat exchanger 100A includes the pipe main body 11 which forms an outer shell of the heat exchanger 100A, a pair of partition plates 20, a supply portion 21, a discharge portion 22, and a core portion 30A.

The pair of partition plates 20 are spaced apart in an extension direction Da which is a direction in which the pipe 10 extends. The pair of partition plates 20 are disposed at both ends of the pipe main body 11 in the extension direction Da. The pair of partition plates 20 include a first partition plate 20A disposed on one side (first side) Da1 of the extension direction Da with respect to the pipe main body 11, and a second partition plate 20B disposed on the other side (second side) Da2 of the extension direction Da with respect to the pipe main body 11. Here, the one side Da1 of the extension direction Da is a downstream side of a flow direction of the first fluid H inside the pipe main body 11. The other side Da2 of the extension direction Da is an upstream side of the flow direction of the first fluid H inside the pipe main body 11. The pair of partition plates 20 (the first partition plate 20A and the second partition plate 20B) each have a plate shape extending along a plane perpendicular to (intersecting with) the extension direction Da. The pair of partition plates 20 each block part of the flow path 10*r* in the extension direction Da. A closed space Sc defined by the first partition plate 20A and the second partition plate 20B is formed in part of the flow path 10*r* inside the pipe 10.

Figure 3:
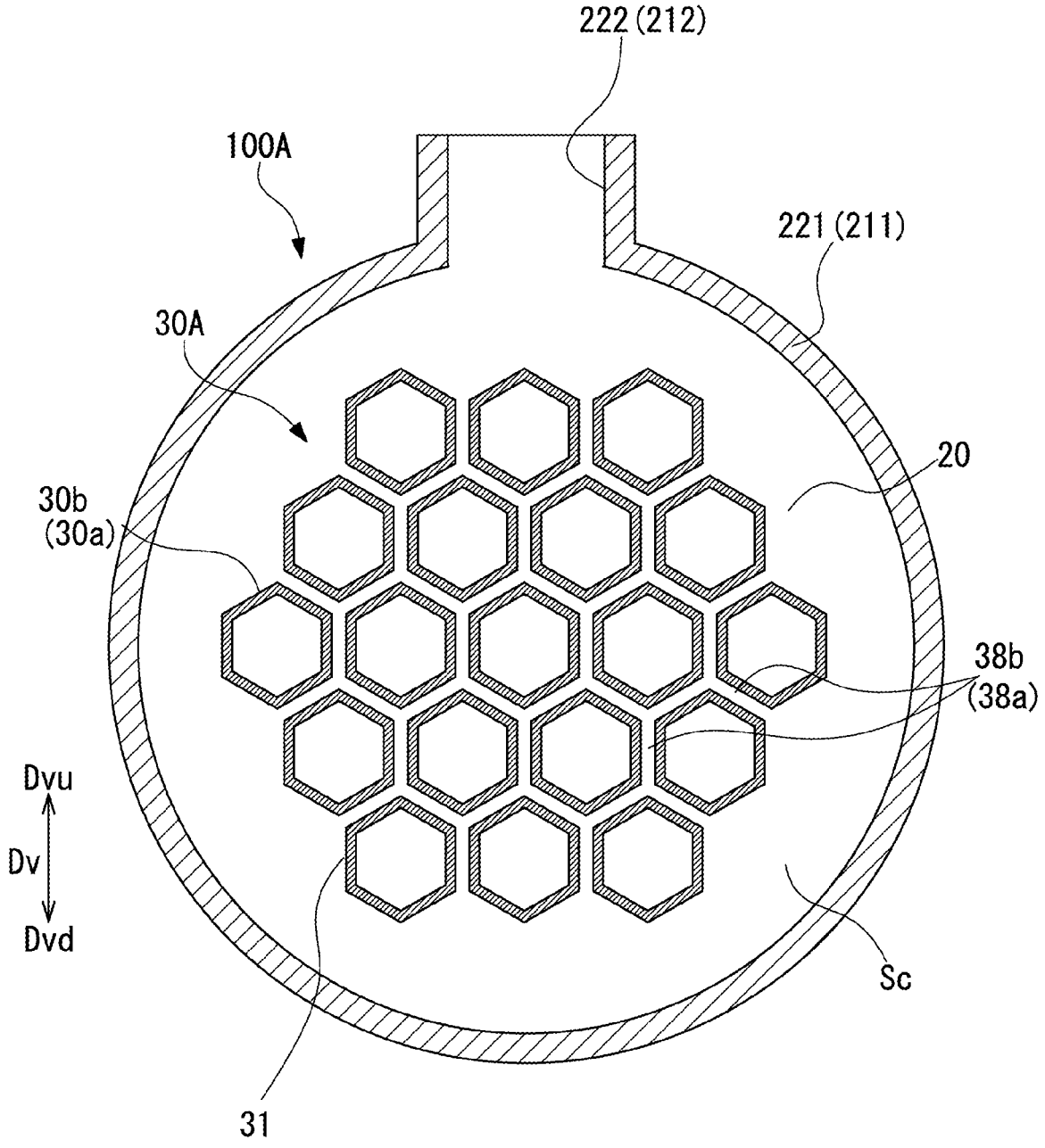
FIG. 3 is a cross-sectional view taken along a line A-A in FIG. 1.

The supply portion 21 is disposed on the one side Da1 of the extension direction Da with respect to the pipe main body 11. The supply portion 21 is connected to the pipe main body 11 as an inlet-side header. The supply portion 21 is configured to supply a second fluid L introduced from the outside to the closed space Sc inside the pipe main body 11. As shown in FIG. 2, the supply portion 21 includes a cylindrical supply portion main body 211 that is open at both ends in the extension direction Da. An opening of the supply portion main body 211 on the one side Da1 of the extension direction Da is blocked by the first partition plate 20A. An opening of the supply portion main body 211 on the other side Da2 of the extension direction Da is connected to the inside of the pipe main body 11. A supply port 212 that connects the outside and the inside of the closed space Sc is formed in the supply portion main body 211 on the other side Da2 of the extension direction Da with respect to the first partition plate 20A. As shown in FIG. 3, the supply port 212 can supply the second fluid L into the closed space Sc from the outside.

The discharge portion 22 is disposed on the other side Da2 of the extension direction Da with respect to the pipe main body 11. The discharge portion 22 is connected to the pipe main body 11 as an outlet side header. The discharge portion 22 is configured to discharge the second fluid L from the closed space Sc inside the pipe main body 11 to the outside. The discharge portion 22 includes a cylindrical discharge portion main body 221 which is open at both ends in the extension direction Da. An opening of the discharge portion main body 221 on the other side Da2 of the extension direction Da is blocked by the second partition plate 20B. An opening of the discharge portion main body 221 on the one side Da1 of the extension direction Da is connected to the inside of the pipe main body 11. In the discharge portion main body 221, a discharge port 222 connecting the inside of the closed space Sc and the outside is formed on the one side Da1 of the extension direction Da with respect to the second partition plate 20B. As shown in FIG. 3, the discharge port 222 can discharge the second fluid L from the inside of the closed space Sc to the outside.

As shown in FIG. 2, the core portion 30A is disposed inside the pipe main body 11. A first end portion 30*a* of the core portion 30A on the one side Da1 of the extension direction Da is covered with the supply portion main body 211 from the outside. A second end portion 30*b* of the core portion 30A on the other side Da2 of the extension direction Da is covered with the discharge portion main body 221 from the outside. The core portion 30A includes a plurality of heat transfer tubes 31 and a flow path forming portion 40A.

The plurality of heat transfer tubes 31 are disposed inside the pipe main body 11. The plurality of heat transfer tubes 31 each extend in the extension direction Da (direction perpendicular to a drawing sheet surface of FIG. 4). An end portion of each heat transfer tube 31 on the one side Da1 of the extension direction Da is disposed in the supply portion 21. An end portion of each heat transfer tube 31 on the other side Da2 of the extension direction Da is disposed in the discharge portion 22. Both ends of each heat transfer tube 31 in the extension direction Da are open. Both ends of each heat transfer tube 31 in the extension direction Da are disposed outside the pair of partition plates 20 in the extension direction Da so as to penetrate the pair of partition plates 20. Both ends of each heat transfer tube 31 are open at positions facing the elbow portions 12.

Figure 4:
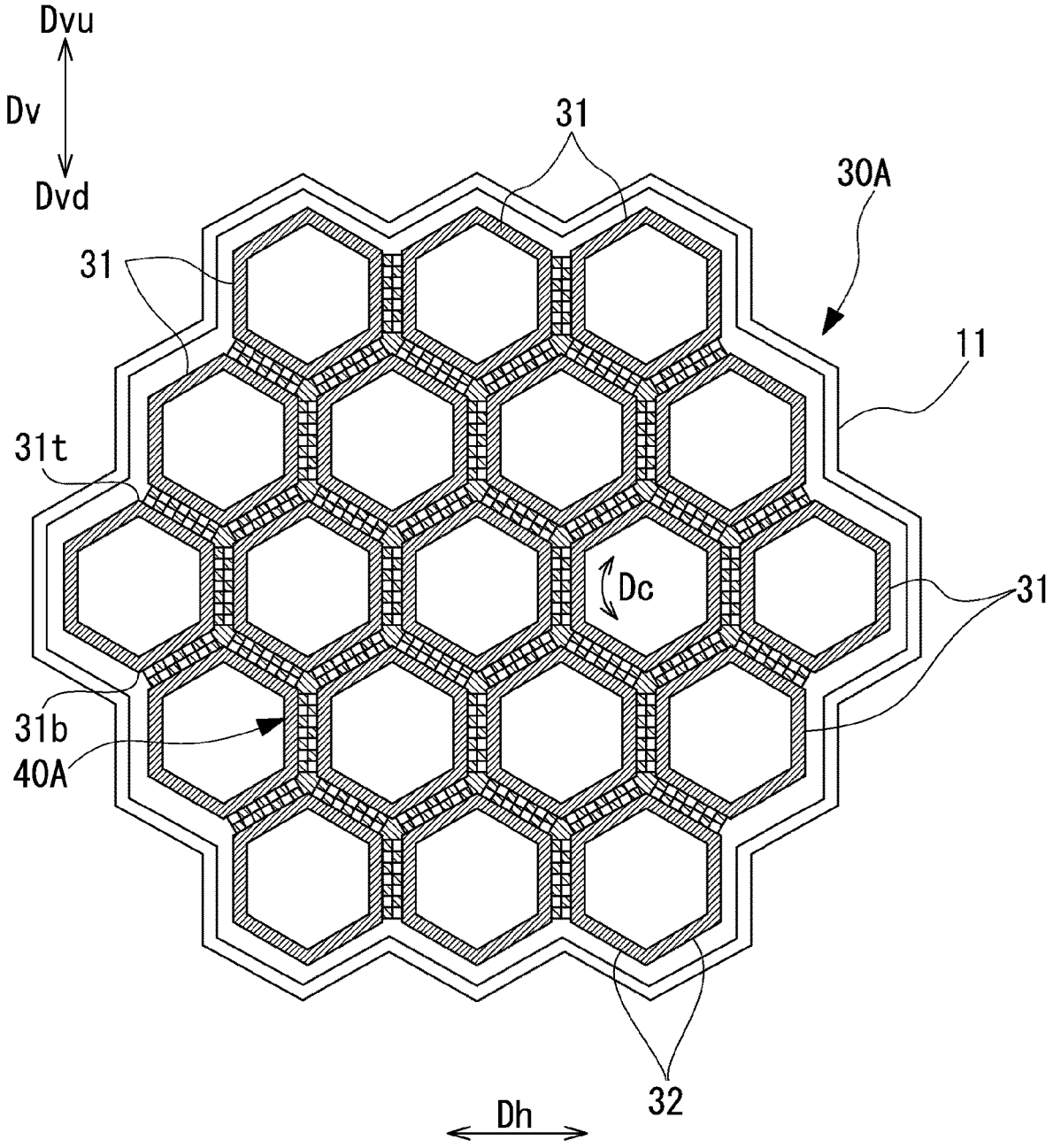
FIG. 4 is a cross-sectional view taken along a line B-B in FIG. 1.

The plurality of heat transfer tubes 31 are arranged side by side at intervals in a direction orthogonal to (intersecting with) the extension direction Da inside the pipe main body 11. As shown in FIGS. 3 and 4, the plurality of heat transfer tubes 31 are disposed in multiple stages in a vertical direction Dv orthogonal to the extension direction Da when viewed from the extension direction Da. In each stage in the vertical direction Dv, a plurality of the heat transfer tubes 31 are disposed in a horizontal direction Dh orthogonal to the extension direction Da and the vertical direction Dv. Each of the vertical direction Dv and the horizontal direction Dh is one of radial directions in the pipe main body 11. The heat transfer tubes 31 in a stage positioned on an upward Dvu side in the vertical direction Dv and the heat transfer tubes 31 in a stage positioned on a downward Dvd side in the vertical direction Dv are disposed with their positions shifted in the horizontal direction Dh. The plurality of heat transfer tubes 31 are disposed in a honeycomb shape when viewed from the extension direction Da. The plurality of heat transfer tubes 31 are arranged such that central positions (central axes 31*c*) have a hexagonal shape as a whole when viewed from the extension direction Da.

Figure 5:
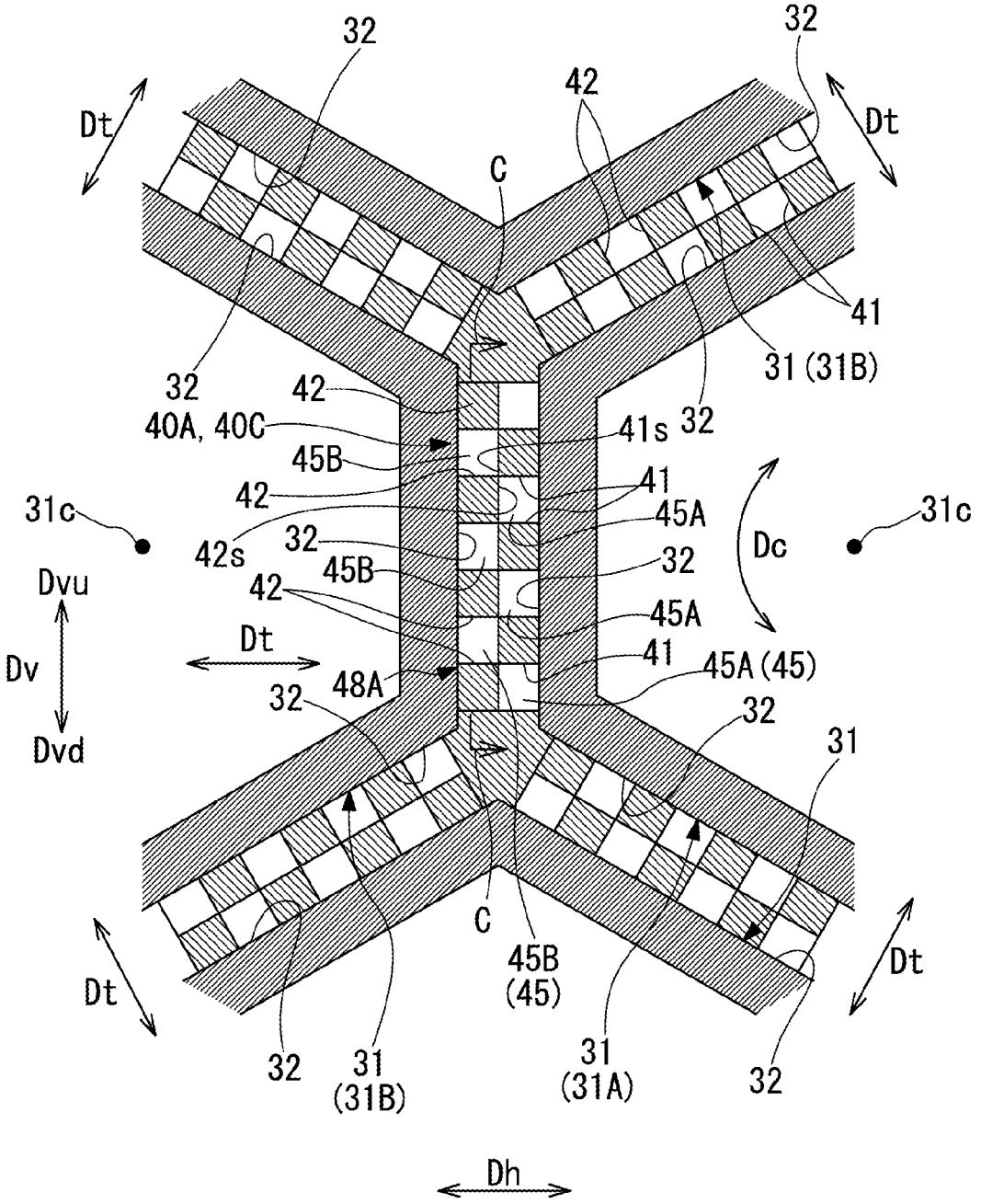
FIG. 5 is an enlarged cross-sectional view showing a flow path forming portion of the heat exchanger.

Each heat transfer tube 31 has, for example, a hexagonal cross-sectional shape along a plane orthogonal to the extension direction Da. That is, each heat transfer tube 31 has six outer surfaces 32 extending in a circumferential direction Dc of one heat transfer tube 31 when viewed from the extension direction Da. Each heat transfer tube 31 is disposed such that one top portion 31*t* faces upward Dvu in the vertical direction Dv and another top portion 31*b* faces downward Dvd in the vertical direction Dv. The plurality of heat transfer tubes 31 are disposed such that the outer surfaces 32 of adjacent heat transfer tubes 31 are parallel to each other. As shown in FIG. 5, the outer surfaces 32 of the heat transfer tubes 31 adjacent to each other in the horizontal direction Dh face each other with a gap in the horizontal direction Dh. The outer surfaces 32 of the heat transfer tubes 31 that are adjacent to each other in a diagonal direction that is inclined with respect to the vertical direction Dv face each other with a gap in the diagonal direction that intersects with the vertical direction Dv and the horizontal direction Dh. The gap between the outer surfaces 32 of two heat transfer tubes 31 adjacent to each other is constant when viewed from the extension direction Da. In the following description, a direction connecting the central axes 31*c* of the two heat transfer tubes 31 adjacent to each other at the closest positions is referred to as a facing direction Dt.

The flow path forming portion 40A forms a plurality of small flow path portions among the plurality of heat transfer tubes 31 that are adjacent to each other at the closest positions in an imaginary plane orthogonal to the extension direction Da in the plurality of heat transfer tubes 31. The flow path forming portion 40A includes a plurality of first protrusion portions 41 and a plurality of second protrusion portions 42.

The plurality of first protrusion portions 41 are formed on each outer surface 32 of one heat transfer tube (first heat transfer tube) 31A of the two heat transfer tubes 31A and 31B that are adjacent to each other at the closest positions. Each first protrusion portion 41 protrudes in the facing direction Dt from each outer surface 32 of the one heat transfer tube 31A toward the other heat transfer tube (second heat transfer tube) 31B. The plurality of first protrusion portions 41 are disposed at intervals in the circumferential direction Dc of each heat transfer tube 31 along each outer surface 32 of the one heat transfer tube 31A when viewed from the extension direction Da. That is, a plurality of the first protrusion portions 41 are formed on one outer surface 32. Each first protrusion portion 41 has a rectangular cross-sectional shape when viewed from the extension direction Da and extends in the extension direction Da.

The plurality of second protrusion portions 42 are formed on each outer surface 32 of the other heat transfer tube 31B of the two heat transfer tubes 31A and 31B adjacent to each other at the closest positions. Each second protrusion portion 42 protrudes in the facing direction Dt from each outer surface 32 of the other heat transfer tube 31B toward the one heat transfer tube 31A. The plurality of second protrusion portions 42 are disposed at intervals in the circumferential direction Dc of each heat transfer tube 31 along each outer surface 32 of the other heat transfer tube 31B when viewed from the extension direction Da. That is, a plurality of the second protrusion portions 42 are formed on one outer surface 32. Each second protrusion portion 42 has a rectangular cross-sectional shape when viewed from the extension direction Da and extends in the extension direction Da.

The first protrusion portion 41 and the second protrusion portion 42 are disposed to be shifted in the circumferential direction Dc when viewed from the extension direction Da. In the first protrusion portion 41 and the second protrusion portion 42, part of a tip 41*s* of the first protrusion portion 41 and part of a tip 42*s* of the second protrusion portion 42 that are adjacent to each other in the circumferential direction Dc are connected when viewed from the extension direction Da. Specifically, when viewed from the extension direction Da, in the first protrusion portion 41 and the second protrusion portion 42 each having a rectangular cross-sectional shape, a corner of the tip 41*s* of the first protrusion portion 41 and a corner of the tip 42*s* of the second protrusion portion 42 are connected.

The flow path forming portion 40A forms the plurality of small flow path portions 45 by the plurality of first protrusion portions 41 and the plurality of second protrusion portions 42. The plurality of small flow path portions 45 are formed between each outer surface 32 of the one heat transfer tube 31A and the other heat transfer tube 31B. The plurality of small flow path portions 45 include a first small flow path portion 45A and a second small flow path portion 45B.

The first small flow path portion 45A is a space surrounded by each outer surface 32 of the one heat transfer tube 31A and the tip 42*s* of the second protrusion portion 42 formed in the other heat transfer tube 31B between the first protrusion portions 41 which are adjacent to each other in the circumferential direction Dc. The first small flow path portion 45A is disposed at a position close to the one heat transfer tube 31A of the two heat transfer tubes 31A and 31B adjacent to each other at the closest positions among the plurality of heat transfer tube 31 in the facing direction Dt.

The second small flow path portion 45B is a space surrounded by each outer surface 32 of the other heat transfer tube 31B and the tip 41*s* of the first protrusion portion 41 formed in the one heat transfer tube 31A side between the second protrusion portions 42 which are adjacent to each other in the circumferential direction Dc. The second small flow path portion 45B is disposed at a position close to the other heat transfer tube 31B of the two heat transfer tubes 31A and 31B adjacent to each other at the closest positions among the plurality of heat transfer tube 31 in the facing direction Dt.

The plurality of first small flow path portions 45A and second small flow path portions 45B are disposed at positions different from each other when viewed from a position where the discharge portion 22 is disposed in the extension direction Da. The first small flow path portion 45A and the second small flow path portion 45B are disposed at positions different from each other in both the facing direction Dt and the circumferential direction Dc. In this manner, the first small flow path portion 45A and the second small flow path portion 45B are disposed in a zigzag pattern when viewed from the extension direction Da.

As shown in FIG. 2, such a flow path forming portion 40A is formed in part of the core portion 30A in the extension direction Da. The flow path forming portion 40A is formed only in a core intermediate portion 30*c* between a first end portion 30*a* on the one side Da1 of the extension direction Da and a second end portion 30*b* on the other side Da2 of the extension direction Da. The flow path forming portion 40A is formed in a part except for the supply portion 21 and the discharge portion 22 between the pair of partition plates 20. That is, in the core portion 30A, the plurality of small flow path portions 45 are not formed and gaps 38*a* and 38*b* are formed between the plurality of heat transfer tubes 31 at a first end portion 30*a* corresponding to the supply portion 21 and a second end portion 30*b* corresponding to the discharge portion 22 in the extension direction Da.

Each component of the heat exchanger 100A having a configuration described above is desirably formed by 3D printer technology represented by additive modeling (AM). Further, titanium alloys and stainless steel alloys (SUS) are preferably used as materials for forming the heat exchanger 100A.

In such a heat exchanger 100A, as shown in FIG. 1, the first fluid H flows through the flow path 10*r* in the pipe 10 from the other side Da2 toward the one side Da1 of the extension direction Da. The first fluid H that has flowed through the elbow portion 12 disposed on the other side Da2 of the extension direction Da with respect to the pipe main body 11 flows into the heat transfer tube 31. The first fluid H flows into each heat transfer tube 31 from an end of the heat transfer tube 31 that is open on the other side Da2 of the extension direction Da with respect to the second partition plate 20B. That is, the first fluid H does not flow into the closed space Sc on the one side Da1 of the extension direction Da with respect to the second partition plate 20B but flows only into the heat transfer tubes 31. The first fluid H flows through the plurality of heat transfer tubes 31 from the other side Da2 toward the one side Da1 of the extension direction Da. The first fluid H that has flowed through the heat transfer tubes 31 flows out to the elbow portion 12 disposed on the one side Da1 of the extension direction Da with respect to the pipe main body 11. The first fluid H that has flowed through the heat transfer tubes 31 flows out into the elbow portion 12 from an end of the heat transfer tube 31 that is open on the one side Da1 of the extension direction Da with respect to the first partition plate 20A.

As shown in FIG. 2, the second fluid L supplied from the outside of the heat exchanger 100A flows into the closed space Sc of the pipe main body 11 from the supply port 212 of the supply portion 21. The second fluid L is a liquid that cools the first fluid H to be cooled. The second fluid L is, for example, liquid oxygen. At the first end portion 30*a* of the core portion 30A disposed in the supply portion 21, the second fluid L flows from the gaps 38*a* formed between the plurality of heat transfer tubes 31 into portions between the plurality of heat transfer tubes 31 disposed in the closed space Sc. Specifically, the second fluid L flows into the plurality of small flow path portions 45 from the gaps 38*a*. The second fluid L flows through the plurality of small flow path portions 45 from the one side Da1 toward the other side Da2 of the extension direction Da. That is, the second fluid L flows in an opposite direction to the first fluid H in the extension direction Da. The second fluid L exchanges heat with the first fluid H flowing through the heat transfer tubes 31 while flowing through the small flow path portions 45, thereby cooling the first fluid H. The second fluid L reaches the gaps 38*b* of the second end portion 30*b* of the core portion 30A disposed in the discharge portion 22 from the plurality of small flow path portions 45. Thereafter, the second fluid L is discharged to the outside from the discharge port 222 of the discharge portion 22 and flows out from the closed space Sc.

Operation and Effect

In the heat exchanger 100A configured as described above, the plurality of small flow path portions 45 are formed by the flow path forming portion 40A between the heat transfer tubes 31 adjacent to each other at the closest positions among the plurality of heat transfer tubes 31. In addition, the plurality of small flow path portions 45 are disposed at positions different from each other when viewed from the position where the discharge portion 22 is disposed in the extension direction Da. Therefore, when the second fluid L flows through the plurality of small flow path portions 45, the second fluid L flows while being in contact with the flow path forming portion 40A that forms an inner surface of each small flow path portion 45. Thus, a contact surface area where the second fluid L comes into contact with the flow path forming portion 40A can be ensured largely between the heat transfer tubes 31 adjacent to each other at the closest positions. In addition, each small flow path portion 45 has a smaller cross-sectional area when viewed from the extension direction Da than a gap between the heat transfer tubes 31 adjacent to each other at the closest positions. Therefore, the flow velocity of the second fluid L flowed into the small flow path portion 45 increases. As a result, the second fluid L flows through the plurality of small flow path portions 45, thereby increasing the heat transfer efficiency compared to a case where the second fluid L flows through the gaps between the heat transfer tubes 31 in which the small flow path portions are not formed. Thus, the heat exchange efficiency between the first fluid H inside the heat transfer tube 31 and the second fluid L outside the heat transfer tube 31 can be increased.

In addition, the flow path forming portion 40A forms the first small flow path portion 45A disposed at a position close to the one heat transfer tube 31A and the second small flow path portion 45B disposed at a position close to the other heat transfer tube 31B. In particular, in the present embodiment, the first small flow path portion 45A and the second small flow path portion 45B are disposed with their positions shifted in the facing direction Dt and the circumferential direction Dc between the two heat transfer tubes 31 adjacent to each other. In this manner, the first small flow path portion 45A and the second small flow path portion 45B are disposed in a zigzag pattern when viewed from the extension direction Da. As a result, a cross-sectional area of each of the first small flow path portion 45A and the second small flow path portion 45B when viewed from the extension direction Da is small compared to a case where one small flow path portion 45 is formed between the heat transfer tubes 31 adjacent to each other at the closest positions. Therefore, the flow velocity of the second fluid L that has flowed into the first small flow path portion 45A and the second small flow path portion 45B further increases. Therefore, the heat transfer efficiency of the second fluid L via the flow path forming portion 40A increases as the second fluid L flows through the first small flow path portions 45A and the second small flow path portions 45B that are disposed in a zigzag pattern. As a result, the heat exchange efficiency between the first fluid H inside the heat transfer tube 31 and the second fluid L outside the heat transfer tube 31 can be further increased.

In addition, the flow path forming portion 40A includes the plurality of first protrusion portions 41 formed on the outer surface 32 of the one heat transfer tube 31A and the plurality of second protrusion portions 42 formed on the outer surface 32 of the other heat transfer tube 31B. Further, when viewed from the extension direction Da, each of the plurality of first protrusion portions 41 and each of the plurality of second protrusion portions 42 are disposed to be shifted in the circumferential direction Dc. As a result, a contact surface area where the second fluid L comes into contact with the flow path forming portion 40A can be ensured largely by the first protrusion portion 41 and the second protrusion portion 42 compared to a case where only any one of the first protrusion portion 41 and the second protrusion portion 42 is formed. As a result, the heat exchange efficiency between the first fluid H inside the heat transfer tube 31 and the second fluid L outside the heat transfer tube 31 can be further increased.

Also, when viewed from the extension direction Da, part of the tip 41*s* of the each of the plurality of first protrusion portions 41 and part of the tip 42*s* of the each of the plurality of second protrusion portions 42 that are adjacent to each other in the circumferential direction Dc are connected. Thus, the first small flow path portion 45A and the second small flow path portion 45B can be formed independently of each other. Therefore, the cross-sectional area when viewed from the extension direction Da can be made small compared to a case where the first small flow path portion 45A and the second small flow path portion 45B are connected. Thus, it is possible to further increase the flow velocity of the second fluid L that has flowed into the first small flow path portion 45A and the second small flow path portion 45B.

Modification Example of First Embodiment

In the above-described first embodiment, when viewed from the extension direction Da, part of the tip 41*s* of the first protrusion portion 41 and part of the tip 42*s* of the second protrusion portion 42 that are adjacent to each other in the circumferential direction Dc are connected, but a structure of the flow path forming portion 40A is not limited to such a structure.

Figure 6:
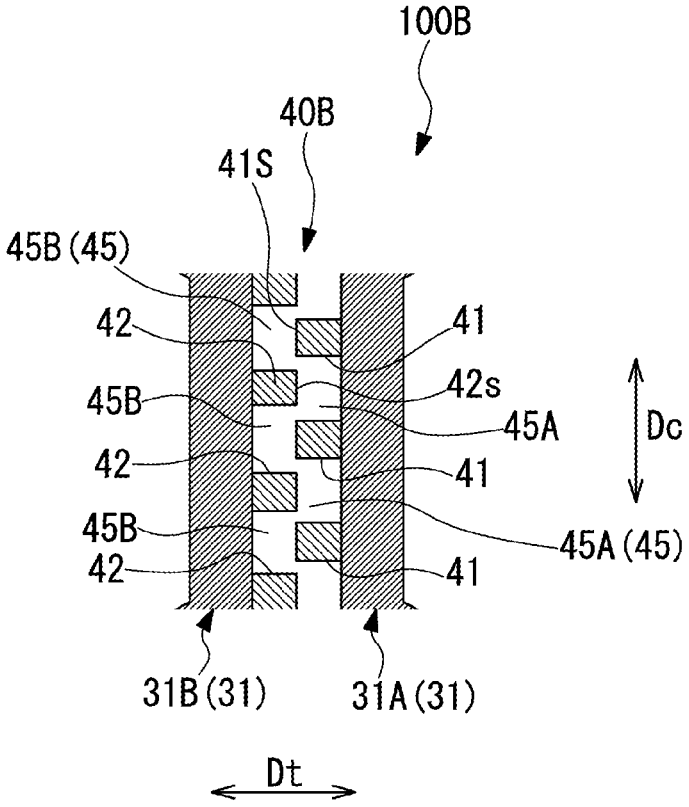
FIG. 6 is a view showing a flow path forming portion of a heat exchanger according to a modification example of the first embodiment of the present disclosure.

For example, as shown in FIG. 6, in the flow path forming portion 40B of a heat exchanger 100B, when viewed from the extension direction Da, the each of the plurality of first protrusion portions 41 and the each of the plurality of second protrusion portions 42 adjacent to each other in the circumferential direction Dc may be spaced apart in the circumferential direction Dc.

According to such a configuration, the first small flow path portion 45A formed between the first protrusion portions 41 adjacent to each other in the circumferential direction Dc communicates with the second small flow path portion 45B formed between the first protrusion portions 41 adjacent to each other in the circumferential direction Dc. Even in such a configuration, the heat exchange efficiency of the second fluid L via the flow path forming portion 40A increases as the second fluid L passes through a plurality of the first small flow path portions 45A and the second small flow path portions 45B. Moreover, since the first protrusion portion 41 and the second protrusion portion 42 are independent, the first protrusion portion 41 and the second protrusion portion 42 are easily formed.

Second Embodiment

Next, a second embodiment of the heat exchanger according to the present disclosure will be described. In addition, in the second embodiment described below, the same reference numerals are given to the configurations common to the above-described first embodiment in the drawings, and the description thereof will be omitted. In the second embodiment, a configuration of part of a flow path forming portion 40C is different from that of the first embodiment.

Figure 7:
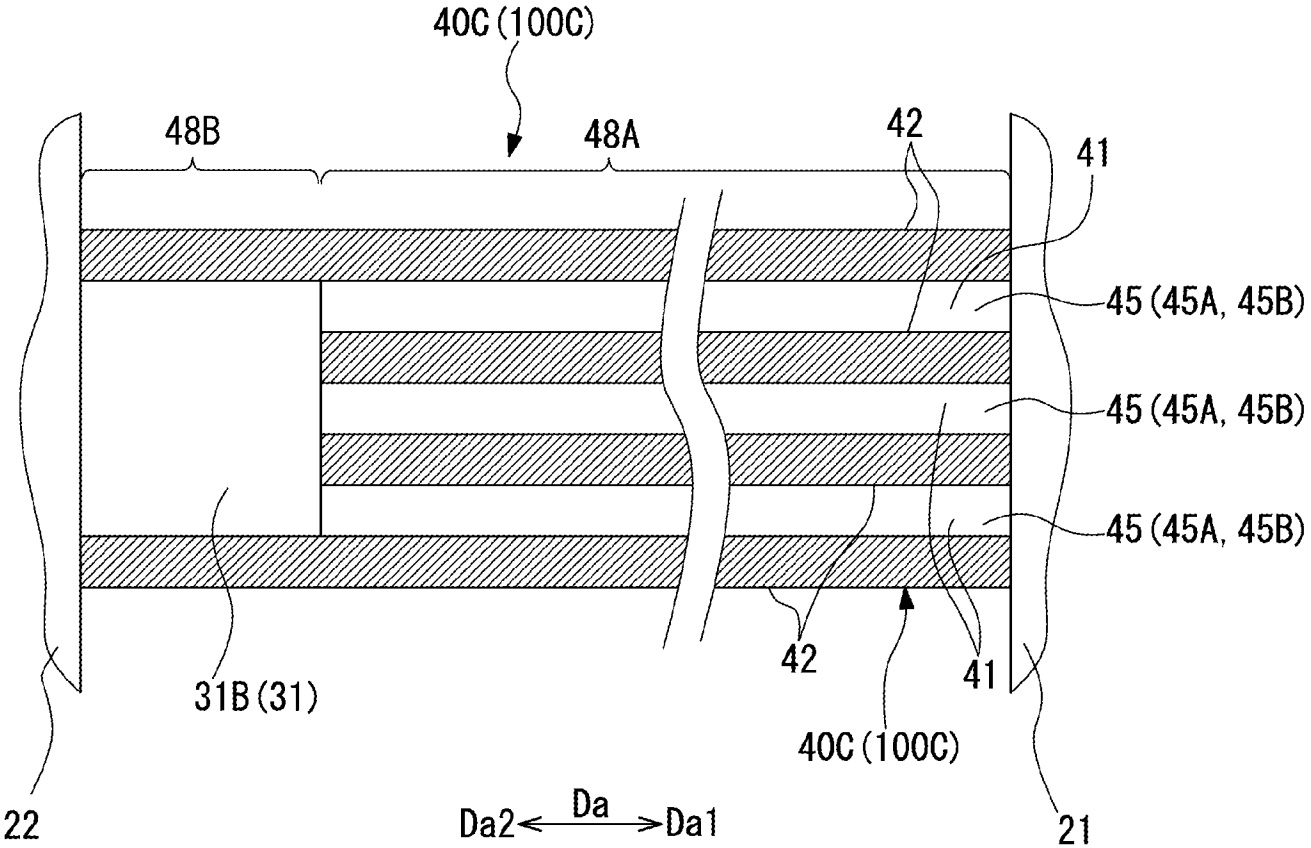
FIG. 7 is a cross-sectional view perpendicular to a facing direction showing a flow path forming portion of a heat exchanger according to a second embodiment of the present disclosure.

As shown in FIG. 7, the flow path forming portion 40C of a heat exchanger 100C is formed such that the flow path cross-sectional area of the small flow path portion when view from the extension direction Da is larger at a position close to the discharge portion 22 than at a position close to the supply portion 21 in the extension direction Da. The flow path forming portion 40C includes a first flow path region 48A and a second flow path region 48B. The first flow path region 48A is formed in a partial region on the one side Da1 of the extension direction Da in the flow path forming portion 40C. The second flow path region 48B is formed in a partial region on the other side Da2 of the extension direction Da with respect to the first flow path region 48A in the flow path forming portion 40C. The second flow path region 48B is formed to have a flow path cross-sectional area when viewed from the extension direction Da larger than that of the first flow path region 48A.

In the first flow path region 48A, as in the flow path forming portion 40A in the first embodiment, as shown in FIG. 5, a plurality of the small flow path portions 45 are formed between the heat transfer tubes 31 adjacent to each other at the closest positions. In other words, the plurality of first protrusion portions 41 and the plurality of second protrusion portions 42 are disposed in the first flow path region 48A. Thus, the plurality of small flow path portions 45 include the first small flow path portion 45A and the second small flow path portion 45B.

At least some of the plurality of first protrusion portions 41 and the plurality of second protrusion portions 42 terminate at a position on the one side Da1 of the extension direction Da with respect to the second flow path region 48B. That is, at least some of the plurality of first protrusion portions 41 and the plurality of second protrusion portions 42 are not formed in the second flow path region 48B. All of the plurality of first protrusion portions 41 and the plurality of second protrusion portions 42 may not be formed in the second flow path region 48B. As a result, at least some of the plurality of small flow path portions 45 (the first small flow path portion 45A and the second small flow path portion 45B) formed in the first flow path region 48A merge with the second flow path region 48B. Therefore, the flow path forming portion 40C is formed to have a flow path cross-sectional area larger than the small flow path portion 45 when view from the extension direction Da at a position close to the discharge portion 22 than at a position close to the supply portion 21 in the extension direction Da.

According to the heat exchanger 100C configured as described above, when a temperature of the first fluid H is higher than a temperature of the second fluid L, the temperature of the second fluid L flowing between the plurality of heat transfer tubes 31 increases due to the heat exchange with the first fluid H passing through the plurality of heat transfer tubes 31. As a result, a property of the second fluid L approaches a gas from a liquid. Thus, a density of the second fluid L may decrease to increase (expand) a specific volume thereof as the second fluid L approaches the discharge portion 22 in the extension direction Da. On the other hand, in the flow path forming portion 40C of the second embodiment, the first flow path region 48A is changed to the second flow path region 48B at a position close to the discharge portion 22. As a result, the flow path cross-sectional area of the small flow path portion 45 when viewed from the extension direction Da in the second flow path region 48B can be increased. Thus, a volume expansion of the second fluid L that has flowed from the first flow path region 48A into the second flow path region 48B can be allowed, and the flow velocity of the second fluid L can be increased in the second flow path region 48B. As a result, the heat exchange efficiency between the first fluid H inside the heat transfer tube 31 and the second fluid L outside the heat transfer tube 31 can be increased.

Further, the second flow path region 48B is formed by merging at least some of the plurality of small flow path portions 45 formed in the first flow path region 48A. Thus, it is possible to easily form a structure in which the flow path cross-sectional area is increased in the middle of the extension direction Da.

Third Embodiment

Next, a third embodiment of the heat exchanger according to the present disclosure will be described. In addition, in the third embodiment described below, the same reference numerals are given to the configurations common to the above-described first embodiment and second embodiment in the drawings, and the description thereof will be omitted. In the third embodiment, a configuration of a flow path forming portion 40D is different from that of the first embodiment and the second embodiment.

Figure 8:
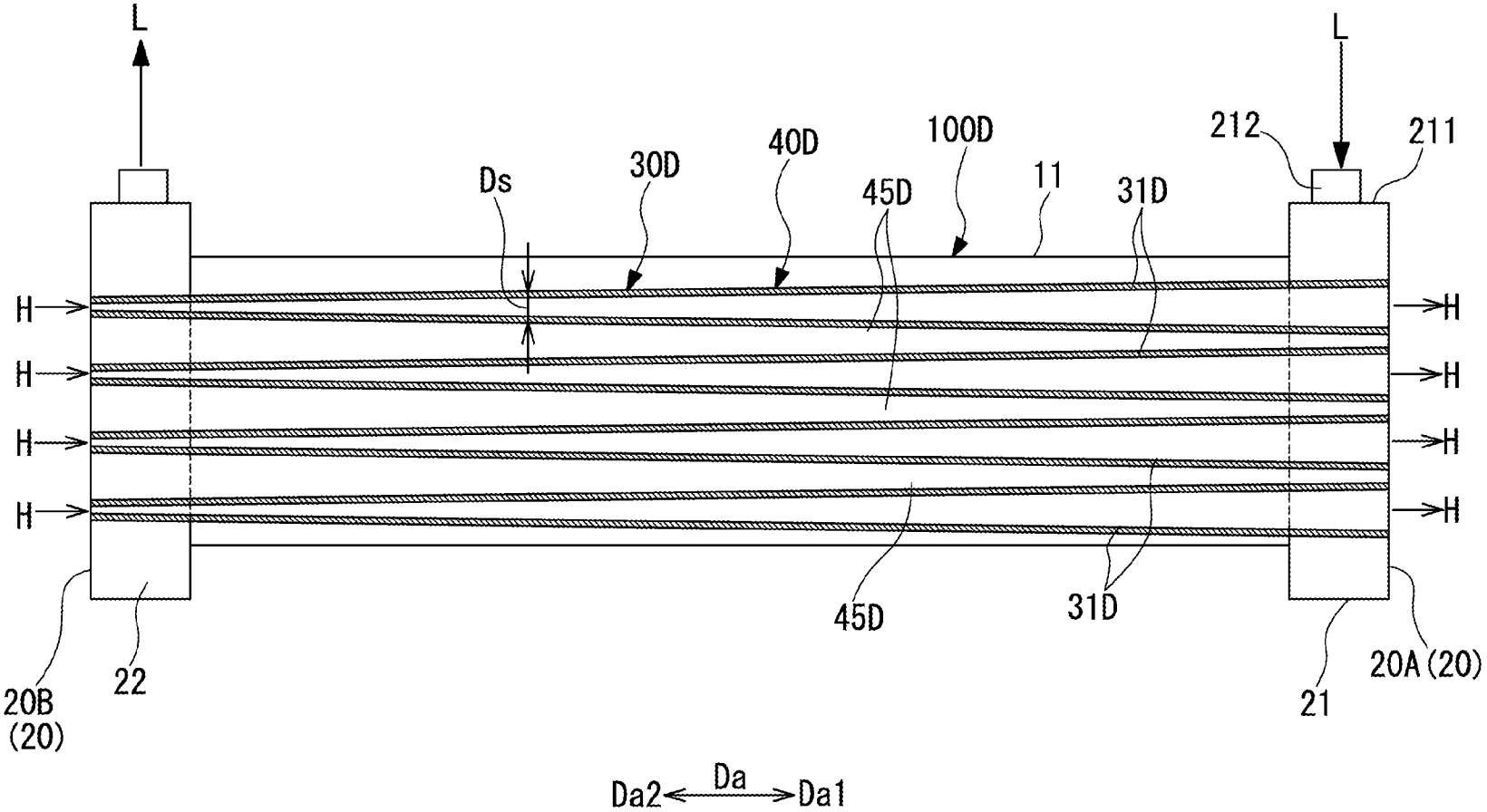
FIG. 8 is a cross-sectional view showing an internal structure of a heat exchanger according to a third embodiment of the present disclosure.

As shown in FIG. 8, a core portion 30D of a heat exchanger 100D includes a plurality of heat transfer tubes 31D and a flow path forming portion 40D.

A flow path cross-sectional area in each heat transfer tube 31D is formed so as to gradually increase from the other side Da2 toward the one side Da1 in the extension direction Da. Therefore, a tube diameter (inner diameter and outer diameter) Ds of each heat transfer tube 31D is formed so as to gradually increase from the other side Da2 toward the one side Da1 of the extension direction Da. In other words, the heat transfer tube 31D is a tube member having a trapezoidal cross section in which the one side Da1 is wider than the other side Da2 of the extension direction Da. Accordingly, a cross-sectional area of a gap (a portion where the flow path forming portion 40D is formed) between the heat transfer tubes 31D adjacent to each other at the closest positions in an imaginary plane orthogonal to the extension direction Da is gradually increases from the one side Da1 toward the other side Da2 of the extension direction Da. In the third embodiment, the gap becomes a small flow path portion 45D. In other words, the flow path forming portion 40D of the third embodiment has a structure that is combined with a wall surface of the heat transfer tube 31D. As a result, a plurality of the small flow path portions 45D have a flow path cross-sectional area when viewed from the extension direction Da that gradually increases from the supply portion 21 toward the discharge portion 22 in the extension direction Da.

According to such a configuration, the small flow path portion 45D serving as a flow path for the second fluid L has a flow path cross-sectional area that gradually increases from the one side Da1 toward the other side Da2 of the extension direction Da. Therefore, an increase in volume of the second fluid L can be allowed, and the flow velocity of the second fluid L can be gradually increased. As a result, the heat exchange efficiency between the first fluid H inside the heat transfer tube 31 and the second fluid L outside the heat transfer tube 31 can be increased.

Other Embodiments

While preferred embodiments of the invention have been described and illustrated above, it should be understood that these are exemplary of the invention and are not to be considered as limiting. Additions, omissions, substitutions, and other modifications can be made without departing from the scope of the invention. Accordingly, the invention is not to be considered as being limited by the foregoing description and is only limited by the scope of the appended claims.

In each of the above-described embodiments, the first small flow path portion 45A and the second small flow path portion 45B are disposed in a zigzag pattern at different positions in both the facing direction Dt and the circumferential direction Dc. However, the small flow path portion 45 is not limited to such a structure. The disposition of the small flow path portion 45 is not limited in any way, and by providing the plurality of small flow path portions 45 having narrowed flow path cross-sectional areas, it is possible to obtain the same operations and effects as those of the above embodiments.

APPENDIX

The heat exchangers 100A to 100D described in the respective embodiments are understood as follows, for example.

(1) A heat exchanger 100A to 100D according to a first aspect includes: a pipe main body 11 forming a flow path 10*r* to which a first fluid H is supplied; a pair of partition plates 20 that are spaced apart in an extension direction Da of the pipe main body 11, block part of the flow path 10*r* in the extension direction Da, and define a closed space Sc in part of the flow path 10*r*; a plurality of heat transfer tubes 31 and 31D that have a tubular shape with both ends open, extend in the extension direction Da to penetrate the pair of partition plates 20, and are disposed side by side at intervals; a supply portion 21 configured to supply a second fluid L from an outside of the pipe main body 11 into the closed space Sc; a discharge portion 22 that is spaced apart from the supply portion 21 in the extension direction Da and configured to discharge the second fluid L in the closed space Sc to the outside of the pipe main body 11; and a flow path forming portion 40A to 40D that forms a plurality of small flow path portions 45 between the plurality of heat transfer tubes 31 and 31D that are adjacent to each other at closest positions in the plurality of heat transfer tubes 31 and 31D, in which the second fluid L flows between the plurality of heat transfer tubes 31 and 31D in the closed space Sc in a direction opposite to a flow direction of the first fluid H, and the plurality of small flow path portions 45 are disposed at positions different from each other when viewed from a position where the discharge portion 22 is disposed in the extension direction Da.

According to such heat exchangers 100A to 100D, when the second fluid L flows through the plurality of small flow path portions 45, the second fluid L flows while being in contact with the flow path forming portion 40A that forms an inner surface of each small flow path portion 45. Thus, a contact surface area where the second fluid L comes into contact with the flow path forming portion 40A can be ensured largely between the heat transfer tubes 31 adjacent to each other at the closest positions. In addition, each small flow path portion 45 has a smaller cross-sectional area when viewed from the extension direction Da than a gap between the heat transfer tubes 31 adjacent to each other at the closest positions. Therefore, a flow velocity of the second fluid L that has flowed into the small flow path portion 45 increases. As a result, the second fluid L flows through the plurality of small flow path portions 45, thereby increasing the heat transfer efficiency compared to a case where the second fluid L flows through the gaps between the heat transfer tubes 31 in which the small flow path portions 45 are not formed. Thus, the heat exchange efficiency between the first fluid H inside the heat transfer tube 31 and the second fluid L outside the heat transfer tube 31 can be increased.

(2) A heat exchanger 100A to 100D according to a second aspect is the heat exchanger 100A to 100D described in (1), in which the flow path forming portion 40A to 40D forms, as the small flow path portions 45, a first small flow path portion 45A disposed at a position close to one heat transfer tube 31 and 31D of two heat transfer tubes 31 and 31D adjacent to each other at the closest positions among the plurality of heat transfer tubes 31, and a second small flow path portion 45B disposed at a position close to the other heat transfer tube 31 and 31D of the two heat transfer tubes 31 and 31D adjacent to each other at the closest positions and disposed at a position shifted in a circumferential direction Dc of the plurality of heat transfer tubes 31 and 31D with respect to the first small flow path portion 45A when viewed from the extension direction Da.

Thus, a cross-sectional area of each of the first small flow path portion 45A and the second small flow path portion 45B when viewed from the extension direction Da is small compared to a case where one small flow path portion 45 is formed between the heat transfer tubes 31 adjacent to each other at the closest positions. Therefore, the flow velocity of the second fluid L that has flowed into the first small flow path portion 45A and the second small flow path portion 45B further increases. Therefore, the heat transfer efficiency of the second fluid L via the flow path forming portion 40A increases as the second fluid L flows through the first small flow path portions 45A and the second small flow path portions 45B. As a result, the heat exchange efficiency between the first fluid H inside the heat transfer tube 31 and the second fluid L outside the heat transfer tube 31 can be further increased.

(3) A heat exchanger 100A to 100D according to a third aspect is the heat exchanger 100A to 100D described in (1) or (2) in which the flow path forming portion 40A to 40D includes a plurality of first protrusion portions 41 that protrude from an outer surface 32 of one heat transfer tube 31A of the two heat transfer tubes 31 adjacent to each other at the closest positions among the plurality of heat transfer tubes 31 toward the other heat transfer tube 31B to extend in the extension direction Da and are disposed at intervals in the circumferential direction Dc of the plurality of heat transfer tubes 31, and a plurality of second protrusion portions 42 that protrude from an outer surface 32 of the other heat transfer tube 31 toward the one heat transfer tube 31 to extend in the extension direction Da and are disposed at intervals in the circumferential direction Dc, and each of the first protrusion portions 41 and each of the second protrusion portions 42 are disposed to be shifted in the circumferential direction Dc when viewed from the extension direction Da.

Thus, a contact surface area where the second fluid L comes into contact with the flow path forming portion 40A can be ensured largely by the first protrusion portion 41 and the second protrusion portion 42 compared to a case where only any one of the first protrusion portion 41 and the second protrusion portion 42 is formed. As a result, the heat exchange efficiency between the first fluid H inside the heat transfer tube 31 and the second fluid L outside the heat transfer tube 31 can be further increased.

(4) A heat exchanger 100A according to a fourth aspect is the heat exchanger 100A described in (3), in which part of a tip 41*s* of the each of the first protrusion portions 41 and part of a tip 42*s* of the each of the second protrusion portions 42, which are adjacent to each other in the circumferential direction Dc are connected when viewed from the extension direction Da.

Thus, the cross-sectional area when viewed from the extension direction Da can be made small compared to a case where the first small flow path portion 45A and the second small flow path portion 45B are connected. Thus, it is possible to further increase the flow velocity of the second fluid L that has flowed into the first small flow path portion 45A and the second small flow path portion 45B.

(5) A heat exchanger 100B according to a fifth aspect is the heat exchanger 100B described in (3), in which the each of the first protrusion portions 41 and the each of the second protrusion portions 42, which are adjacent to each other in the circumferential direction Dc are spaced apart in the circumferential direction Dc when viewed from the extension direction Da.

As described above, since the first protrusion portion 41 and the second protrusion portion 42 are independent, the first protrusion portion 41 and the second protrusion portion 42 are easily formed.

(6) A heat exchanger 100C and 100D according to a sixth aspect is the heat exchanger 100C and 100D described in any one of (1) to (5), in which in the flow path forming portion 40C and 40D, a flow path cross-sectional area of each of the plurality of small flow path portions 45 when viewed from the extension direction Da is formed larger at a position closer to the discharge portion 22 than that at a position closer to the supply portion 21 in the extension direction Da.

Thus, the flow path cross-sectional area of the small flow path portion 45 when viewed from the extension direction Da at a position close to the discharge portion 22 can be increased. Therefore, a volume expansion of the second fluid L that has flowed from the supply portion 21 toward the discharge portion 22 can be allowed, and the flow velocity of the second fluid L can be increased at a position close to the discharge portion 22. As a result, the heat exchange efficiency between the first fluid H inside the heat transfer tube 31 and the second fluid L outside the heat transfer tube 31 can be increased.

(7) A heat exchanger 100C according to a seventh aspect is the heat exchanger 100C described in (6), in which at least some of the plurality of small flow path portions 45 merge with each other in a middle of the extension direction Da.

Thus, it is possible to easily form a structure in which the flow path cross-sectional area is increased in the middle of the extension direction Da.

(8) A heat exchanger 100D according to an eighth aspect is the heat exchanger 100D described in (6), in which in the plurality of small flow path portions 45D, a flow path cross-sectional area when viewed from the extension direction Da gradually increases from the supply portion 21 toward the discharge portion 22 in the extension direction Da.

Thus, an increase in volume of the second fluid L can be allowed, and the flow velocity of the second fluid L can be gradually increased. As a result, the heat exchange efficiency between the first fluid H inside the heat transfer tube 31 and the second fluid L outside the heat transfer tube 31 can be increased.

EXPLANATION OF REFERENCES

10: Pipe
10*c*: Bent portion
10*r*: Flow path
11: Pipe main body
12: Elbow portion
13: Vane
20: Partition plate
20A: First partition plate
20B: Second partition plate
21: Supply portion
22: Discharge portion
30A, 30D: Core portion
30*a*: First end portion
30*b*: Second end portion
30*c*: Core intermediate portion
31, 31A, 31B, 31D: Heat transfer tube
31*b*: Top portion
31*c*: Central axis
31*t*: Top portion
32: Outer surface
38*a*, 38*b*: Gap
40A to 40D: Flow path forming portion
41: First protrusion portion
41*s*: Tip

42: Second protrusion portion
42*s*: Tip
45, 45D: Small flow path portion
45A: First small flow path portion
45B: Second small flow path portion
48A: First flow path region
48B: Second flow path region
100A to 100D: Heat exchanger
211: Supply portion main body
212: Supply port
221: Discharge portion main body
222: Discharge port
Da: Extension direction
Da1: One side
Da2: The other side
Dc: Circumferential direction
Dh: Horizontal direction
Ds: Tube diameter
Dt: Facing direction
Dv: Vertical direction
H: First fluid
L: Second fluid
Sc: Closed space

What is claimed is:

1. A heat exchanger comprising:

a pipe main body forming a flow path to which a first fluid is supplied;

a pair of partition plates that are spaced apart in an extension direction of the pipe main body, that block part of the flow path in the extension direction, and that define an enclosed space in part of the flow path;

a plurality of heat transfer tubes that each have a tubular shape with both ends open, that extend in the extension direction to penetrate the pair of partition plates, and that are disposed side by side and spaced from each other;

a supply portion configured to supply a second fluid from outside of the pipe main body into the enclosed space;

a discharge portion that is spaced apart from the supply portion in the extension direction and that is configured to discharge the second fluid in the enclosed space to the outside of the pipe main body; and a flow path forming portion that forms a plurality of small flow path portions between any two immediately adjacent heat transfer tubes out of the plurality of heat transfer tubes, wherein the second fluid flows between the plurality of heat transfer tubes in the enclosed space in a direction opposite to a flow direction of the first fluid, and the plurality of small flow path portions are disposed at positions different from each other when viewed from the position where the discharge portion is disposed in the extension direction.

2. The heat exchanger according to claim 1, wherein in the flow path forming portion, a flow path cross-sectional area of each of the plurality of small flow path portions is larger at a position closer to the discharge portion than at a position closer to the supply portion in the extension direction.

3. The heat exchanger according to claim 2, wherein at least some of the plurality of small flow path portions merge with each other in the middle of the flow path forming portion in the extension direction.

4. The heat exchanger according to claim 2, wherein in the plurality of small flow path portions, the flow path cross-sectional area increases from the supply portion toward the discharge portion in the extension direction.

5. A heat exchanger comprising:

a pipe main body forming a flow path to which a first fluid is supplied;

a pair of partition plates that are spaced apart in an extension direction of the pipe main body, that block part of the flow path in the extension direction, and that define an enclosed space in part of the flow path;

a plurality of heat transfer tubes that each have a tubular shape with both ends open, that extend in the extension direction to penetrate the pair of partition plates, and that are disposed side by side and spaced from each other;

a supply portion configured to supply a second fluid from outside of the pipe main body into the enclosed space;

a discharge portion that is spaced apart from the supply portion in the extension direction and that is configured to discharge the second fluid in the enclosed space to the outside of the pipe main body; and a flow path forming portion that forms a plurality of small flow path portions between any two immediately adjacent heat transfer tubes out of the plurality of heat transfer tubes, wherein the second fluid flows between the plurality of heat transfer tubes in the enclosed space in a direction opposite to a flow direction of the first fluid, the plurality of small flow path portions are disposed at positions different from each other when viewed from the position where the discharge portion is disposed in the extension direction, and wherein the flow path forming portion includes:

a plurality of first protrusion portions that protrude from an outer surface of one of the any two immediately adjacent heat transfer tubes toward the other of the any two immediately adjacent heat transfer tubes to extend in the extension direction and that are spaced from each other in a circumferential direction of the plurality of heat transfer tubes, a plurality of second protrusion portions that protrude from an outer surface of the other of the any two immediately adjacent heat transfer tubes toward the one of the any two immediately adjacent heat transfer tubes to extend in the extension direction and are disposed at intervals in the circumferential direction, and wherein each of the plurality of first protrusion portions and each of the plurality of second protrusion portions are disposed so as to be shifted relative to each other in the circumferential direction when viewed from the extension direction.

6. The heat exchanger according to claim 5, wherein part of a tip of each of the first protrusion portions of the plurality of first protrusion portions and part of a tip of each of the second protrusion portions of the plurality of second protrusion portions which are adjacent to each other in the circumferential direction are connected to each other when viewed from the extension direction.

7. The heat exchanger according to claim 5, wherein each of the first protrusion portions of the plurality of first protrusion portions and each of the second protrusion portions of the plurality of second protrusion portions which are adjacent to each other in the circumferential direction are spaced apart from each other in the circumferential direction when viewed from the extension direction.

* * * * *